US005156025A

United States Patent [19]

Frucco

[11] Patent Number: 5,156,025

[45] Date of Patent: Oct. 20, 1992

[54] CONTROL APPARATUS FOR A LAUNDRY WASHING AND/OR DRYING MACHINE

[75] Inventor: Giuseppe Frucco, Pordenone, Italy

[73] Assignee: Zanussi Elettrodomestici S.P.A., Pordenone, Italy

[21] Appl. No.: 769,545

[22] Filed: Oct. 1, 1991

[30] Foreign Application Priority Data

Oct. 9, 1990 [IT] Italy ..... 45760 A/90

[51] Int. Cl.[5] ..... D06F 39/02

[52] U.S. Cl. ..... 68/12.02; 34/43; 68/12.27

[58] Field of Search ..... 68/12.02, 12.27, 13 R; 34/43, 50

[56] References Cited

U.S. PATENT DOCUMENTS 4,738,034 4/1988 Muramatsu et al. ..... 34/43

FOREIGN PATENT DOCUMENTS 1071099 4/1986 Japan ..... 34/43
3147500 6/1988 Japan ..... 34/43
2-220698 9/1990 Japan ..... 34/43

*Primary Examiner*—Philip R. Coe
*Attorney, Agent, or Firm*—Pearne, Gordon, McCoy & Granger

[57] ABSTRACT

A control apparatus for a laundry washing and/or drying machine which is adapted to identify the type of fabrics to be laundered or dried and to automatically select the most suitable program cycle for the laundering or drying of the laundry. The apparatus includes a digital counter (10) and a discharge element (2) connected in parallel to sensors (5, 6) for measuring the electrostatic charge of the laundry produced during rotation of the drum. The discharge element produces a sudden discharge of the electrostatic charge accumulated in the course of different periods of time, the lengths of which depend on the type of fabrics to be laundered or dried. The apparatus also includes a digital comparator (12) which compares the number of clock signals counted by the digital counter (10) between discharge operations of the discharge element (2) to predetermined voltage levels, for controlling, by way of respective logic AND gates (13, 14), the execution of the most suitable program cycle for the laundering or drying of any fabric thus identified.

9 Claims, 1 Drawing Sheet

CONTROL APPARATUS FOR A LAUNDRY WASHING AND/OR DRYING MACHINE

BACKGROUND OF THE INVENTION

1. Field of the Invention

The invention relates generally to a control apparatus for a laundry washing and/or drying machine and, in particular, to a control apparatus which identifies the type of fabrics present in the drum of the machine for laundering or drying, and automatically selects the most suitable program cycle for the laundering or drying of the fabrics.

2. Description of Related Art

Known laundry washers are provided with an electromechanical or electronic program control unit, the latter type usually including a microprocessor, for controlling the execution of predetermined laundering cycles. Such known laundry washers are also typically provided with a number of pushbutton switches associated with various types of fabrics, i.e. wool, cotton, synthetics, etc., of the laundry to be laundered. Each of these switches is actuated in accordance with the type of fabrics be laundered, to thereby selecting in a per se known manner the most suitable program cycle for the laundering of specific fabrics.

In another type of known laundry washers, program control units of the general type described above are designed to optimize the execution of laundering cycles in accordance with predetermined parameters such as type and quantity of the fabrics to be laundered. These predetermined parameters are accessed by the program control unit upon actuation of associated selector pushbuttons, thereby obtaining satisfactory results of the laundry washing operation with the lowest possible consumption of water, detergents and electric energy. While machines of this construction function in a satisfactory and reliable manner, they still require a number of pushbuttons for selecting the type of fabrics to be laundered because they are incapable of automatically selecting and controlling the execution of optimized laundering cycles in accordance with the type of fabrics present in the drum of the machine.

SUMMARY OF THE INVENTION

It is therefore an object of the present invention to eliminate the aforementioned shortcomings of the known laundry washers or dryers by providing a control apparatus for a laundry washing or drying machine which operates without the aid of selector pushbuttons and is adapted to identify the type of fabrics to be laundered or dried, to thereby automatically determine and implement the most suitable program cycle for the laundering and drying of the specific fabrics.

These and other objects are attained by a control apparatus of a construction substantially as set forth in the following description and appended claims.

BRIEF DESCRIPTION OF THE PREFERED EMBODIMENT

The characteristics of the invention will become more evident from the following description, given by way of example with reference to the accompanying drawing, wherein: FIG. 1 shows an electric circuit diagram of a control apparatus for a laundry washer in accordance with a preferred embodiment of the invention.

DETAILED DESCRIPTION OF THE PREFERRED EMBODIMENT

Figure 1:
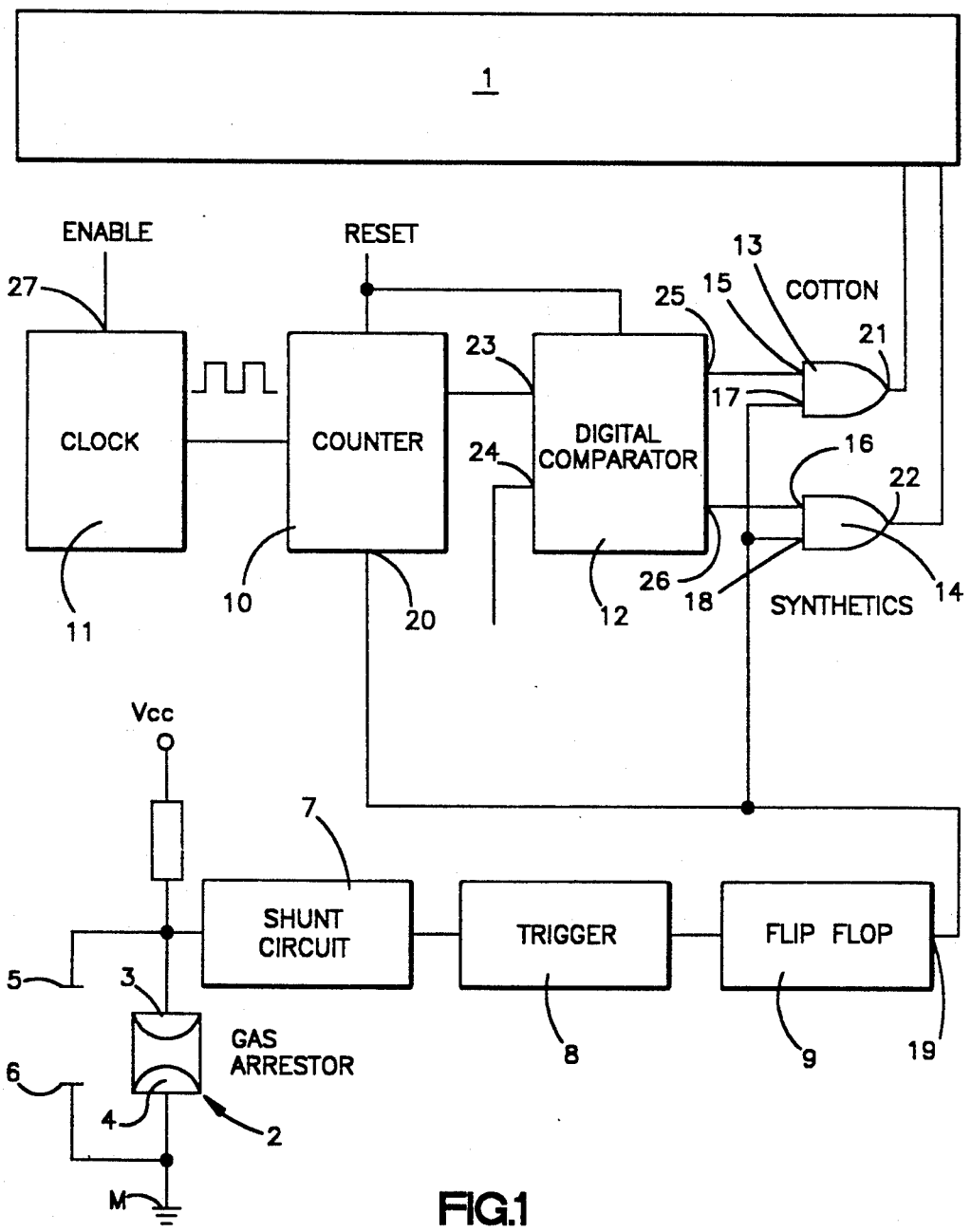

The control apparatus depicted in FIG. 1 drawing is designed for an otherwise not shown conventional laundry washer having a laundering tub with a rotatable drum for containing the laundry to be washed, and a window or door for closing the front access opening of the drum. As shown in the drawing, the laundry washer also includes a substantially conventional microprocessor program control unit 1 programmed to store a number of different laundering program cycles. The program cycles are selected by respective per se known selector elements (not shown) associated with the program control unit, in accordance with the type and quantity of the fabrics of the laundry to be washed. The program control unit 1 is electrically connected to various electric components of the machine such as heater elements, pressure switches, solenoid valves and the like, to control the activation and deactivation of these electric components in accordance with the selected laundering cycle.

The electric circuit of the control apparatus according to the invention includes at least one discharge element 2 or the like, preferably in the form of a conventional gap arrester. The discharge elements electrodes 3 and 4 are each electrically connected to a respective sensor 5, 6 which detects the electrostatic charge of the laundry resulting from the friction of the different pieces of the laundry between one another and the internal walls of the drum as the later is being rotated. Sensors 5 and 6 are disposed inside the drum at spaced locations permitting them to come into contact with the laundry, preferably on the inside wall surface of the closure window or door. The electrodes 3, 4 of discharge element 2 are steadily charged in response to the electrostatic charges produced in the laundry and detected by sensors 5 and 6, resulting in an abrupt discharge between the two electrodes as soon as the predetermined dielectric strength of the discharge element is exceeded. This typically occurs after a limited period of time for example, in the order of a few minutes. The present control apparatus is based on the recognition that the electrostatic charging of the laundry proceeds more or less rapidly in accordance with the type of the laundry fabrics present in the laundry tub. Therefore, the breakdown voltage of discharge element 2 is attained after periods of different duration for different types of fabrics. For determining the duration of the charging period of discharge element 2 for the type of fabrics to be laundered, electrodes 3 and 4 are connected respectively to sensor 5 and a stabilized DC reference voltage source Vcc, and to sensor 6 and to ground M. Electrode 3 is also connected by way of a shunt circuit 7, a trigger circuit 8, and a flip-flop 9, to a digital counter 10 itself connected to the output of a clock signal generator 11 which generates a square wave signal of a predetermined frequency to aid the determination of the duration of the charging period of discharge element 2 as will be described hereafter. Shunt circuit is designed to receive the short voltage pulses generated by the discharge of the electrostatic charges accumulated by electrodes 3, 4 of discharge element 2, and to convert these pulses into pulses of a shape permitting them to be subsequently processed. These pulses are then applied to trigger circuit 8 which converts them into corresponding square wave pulses of a predetermined duration. The square wave pulses generated by trigger circuit 8 are applied to flip-flop 9 which in response to each commutation generates a signal to be applied to counter 10. Hence, the counting operation of counter 10 is stopped at the instant of discharge through discharge element 2, thereby permitting the type of fabrics of the laundry to be washed to be determined in the manner to be described hereafter.

Counter 10 is connected to microprocessor program control unit 1 by way of a conventional digital comparator circuit 12 and a pair of logic AND gates, 13 and 14. The two logic AND gates 13 and 14 have their first inputs 15 and 16, respectively connected to counter 10 by way of comparator 12, and their second inputs 17 and 18, respectively, connected to the output 19 of flip-flop 9, itself connected to input 20 of counter 10. The output terminals 21 and 22 of gates 13 and 14, respectively, are directly connected to microprocessor program control unit 1. The digital comparator 12 is provided with plurality of first inputs 23 connected to digital counter 10, and a plurality of second inputs 24 having applied thereto predetermined reference voltages in an encoded form. The reference voltages have been experimentally determined and correspond to respective counting periods of counter 10, as calculated from the instant at which the electrostatic charges generated by the movement of the laundry in the drum, commence to be accumulated on the electrodes 3 and 4 of discharge element 2, to the instant at which these charges are discharged through the dielectric of the discharge element in response to attaining its dielectric strength.

In the present embodiment, some of the plurality of second inputs 24 of comparator 12 are connected to a range of predetermined reference voltages in encoded form corresponding to a relatively long charging time of discharge element 2 indicative of the presence of cotton fabrics, while others of these encoded reference voltages correspond to shorter charging periods of discharge element 2 and are thus indicative of the presence of synthetic fabrics. In response to the comparison of these predetermined reference voltage levels to the signal appearing at the output of counter 10, the outputs 25 and 26 of comparator 12 connected to first inputs 15 and 16 of logic AND gates 13 and 14, respectively, are commuted from one logic state to the other. This causes one of logic AND gates 13 and 14 to assume a logic state corresponding to the type of fabrics identified by the present control apparatus, in response to which the respective logic gate becomes effective to initiate the execution of the laundering cycle established for the thus identified fabrics under the control of microprocessor program control unit 1. By applying the described criteria, it is also possible to automatically detect the presence of other types of fabrics and to correspondingly control the execution of other laundering cycles particularly suitable for these fabrics, by the provision, in addition to the comparator and logic gates described above by way of example, of additional comparators and logic gates of different types without thereby leaving the scope of protection as claimed for the present invention.

The present control apparatus operates as follows: After the laundry has been deposited into the drum, and prior to the admission of water and detergents to the tub of the machine, microprocessor program control unit 1 starts the rotation of the drum, with the resultant agitation of the laundry, and at the same time generates an enable signal 27 to be applied to clock signal generator 11. Under these conditions, while the laundry commences to produce friction-generated electrostatic charges which are progressively accumulated on electrodes 3 and 4 of discharge element 2, clock signal generator 11 starts to generate square wave-shaped clock signals which are counted by digital counter 10 to thereby determine the duration of the period required for the accumulation of the electrostatic charges generated by the laundry on the electrodes of the discharge element. The counter being enabled to execute this counting operation because during this initial stage there occurs no switching operation of flip-flop 9, so that the latter does not generate a counter disable signal.

Digital counter 10 converts the counted square wave-shaped clock signals into determined voltage levels to be applied to comparator 12, which acts to continually compare the output of the counter 10 to the above-mentioned reference voltage levels. As digital counter 10 counts the square wave-shaped clock signals, the result of the comparison is indicated at the two outputs 25 and 26 of comparator 12 by their assuming logic level "1" or "0", resulting in that inputs 15 and 16 of logic AND gates 13 and 14, respectively, are at the same level. Since second inputs 17 and 18 of AND gates 13 and 14, respectively, are maintained at logic level "0" as long as output 19 of flip-flop 9 is at logic level "0" while discharge element 2 is being charged, outputs 21 and 22 of AND gates 13 and 14, respectively, are also at logic level "0", so that microprocessor program control unit 1 remains in its initial operative state.

In this manner the electrostatic charges produced by the laundry are accumulated by electrodes 2 and 3 of discharge element 2, until the dielectric strength thereof is attained, resulting in a sudden discharge of the accumulated electrostatic charges through the dielectric of the discharge element. In response thereto, and with the aid of the applied DC reference voltage Vcc, a sudden pulse is generated which in the manner described above is processed by shunt circuit 7 and trigger circuit 8, resulting in the commutation of flip-flop 9 to its other operative state to thereby generate a disable signal to be applied to input 20 of counter 10 for stopping its counting operation. At the same time second inputs 17 and 18 of logic AND gates 13 and 14, respectively, commutate to logic level "1". If, under these conditions, the pulses counted by counter 10 result in the generation of a voltage level in the lower range of the voltages stored in comparator 12 and indicative of the presence of synthetic fabrics characterized, as already explained, only output 26 of comparator 12 is commuted to logic level "1", so that this level is applied to first input 16 of AND gate 14 connected to output 26.

Since under these conditions the second input 18 of the AND gate 14 has also been commuted to logic level "1" by the action of flip-flop 9, output 22 of gate 14 is likewise commuted to logic level "1", causing microprocessor program control unit 1 to initiate the execution of a laundering cycle for synthetic fabrics.

In the meantime the other logic AND gate 13 remains inactive, since the other output 25 of comparator 12 is maintained at logic level "0" due to the fact that the discharge of the electrostatic charges through the dielectric of discharge element 2 has occured before the reference voltage level applied to comparator 12 has attained the range indicative of the presence of for instance cotton fabrics. Therefore, output 21 of AND gate 13 remains at logic level "0".

In an analogous manner, when on termination of the counting operation of counter 10, i.e. at the end of the charging period of discharge element 2, the voltage level resulting from the counted pulses lies in the higher range of the reference voltage levels stored in comparator 12, it is indicative of the presence of cotton fabrics. In this case the period of time required for the discharge of the accumulated electrostatic charges through the dielectric of discharge element 2 to occur is longer than in the case of synthetic and only output 25 of comparator 12 is commutated to logic level "1". Therefore, logic level 1 is also applied to first input 15 of AND gate 13 connected to output 25. Under these circumstances, since second input 17 of AND gate 13 has also been commutated to logic level "1" by the action of flip-flop 9, output 21 of AND gate 13 is likewise commutated to logic level "1" to thereby cause microprocessor program control unit 1 to initiate a laundering cycle for cotton fabrics.

The other output 26 of comparator 12 is maintained at logic level "0" because the discharge of the electrostatic charges through the dielectric of discharge element 2 occurred after the reference voltage applied to comparator 12 has attained the range indicative of the presence of, for instance, cotton fabrics. Therefore, the output 22 of AND gate 14 remains at logic level "0".

Subsequently, on termination of the selected synthetic or cotton fabric laundering cycle, in the course of which clock signal generator 11 is disabled by the action of microprocessor program control unit 1, the latter acts to reset counter 10 to zero in preparation for a renewed counting operation. Similarly comparator 12 is reset to thereby commutate to logic level "0" the output of the logic AND gate which had been at logic level "1".

The present control apparatus is thus returned to a state of preparedness for identifying the type of laundry fabrics and for automatically selecting the suitable laundering cycle in the manner described.

In an advantageous embodiment, counter 10, clock signal generator 11, digital comparator 12 and logic AND gates 13 and 14 may be incorporated or integrated in microprocessor 1 to thereby simplify the circuitry of the present control apparatus. The apparatus may otherwise also be used in laundry drying machines by suitably adapting it for identification of the fabrics to be dried and for the automatic selection of suitable drying cycles in a procedure similar to the one described.

The thus designed control apparatus is capable of rapidly and automatically identifying the type of fabric of the laundry to be laundered and/or dried in a laundry washer and/or dryer, and of automatically selecting the most suitable laundering and/or drying cycle without the aid of conventionally provided pushbuttons used for selecting the respective cycles in accordance with the types of fabrics to be laundered and/or dried, to result in a simplification of the construction and operation of these machines.

I claim:

1. A control apparatus for a laundry washing or drying machine, said machine having a rotatable drum for containing the laundry and provided with electrodes adapted to be contacted by the laundry, and an electronic program control unit for selecting and controlling the execution of respective laundering or drying cycles comprising: electrostatic discharge means (2) connected to said electrodes (5, 6) and adapted to accumulate electrostatic charges produced by the laundry during rotation of the drum prior to the initiation of any laundering or drying cycle, said electrostatic discharge means discharging said electrostatic charges on attainment of a predetermined charge voltage level, counter means (10, 11) connected to said electrostatic discharge means (2) through processing and activating means (7, 8, 9) and adapted to count in an encoded form the duration from the start of accumulation of the electrostatic charges to their discharge through said electrostatic discharge means (2), and comparator means (12) connected to said counter means (10, 11) and, through selector control means (13, 14) to said electronic program control unit (1), said comparator means (12) being adapted in cooperation with said selector control means (13, 14) and said electronic program control unit (1) to select different laundering or drying cycles in accordance with different types of fabrics to be laundered or dried, in response to the comparison, in an encoded form, of the count of said duration to at least one reference count representative of a determined type of fabric.

2. A control apparatus according to claim 1, wherein said electrostatic discharge means comprises at least one conventional discharge element (2), respective electrodes (3, 4) of which are connected to a DC reference voltage (Vcc) of a predetermined level and to ground (M), in addition to being connected to said drum electrodes (5, 6).

3. A control apparatus according to claim 2, wherein said processing means comprises at least a shunt circuit (7) and a trigger circuit (8) connected to one another and to said DC reference voltage (Vcc) of said discharge element (2), said activating means comprising at least one flip-flop circuit (9) connected to said shunt circuit (7) and said trigger circuit (8).

4. A control apparatus according to claim 1, wherein said counter means comprises at least a conventional resettable digital counter (10) connected at its input side to a square-wave clock signal generator (11) and provided with an input (20) connected to said flip-flop circuit (9).

5. A control apparatus according to claim 4, wherein said comparator means comprises at least one resettable digital comparator (12) provided with a plurality of first and second inputs (23, 24) connected respectively to said digital counter (10) and to a plurality of DC reference voltages of predetermined levels, and having at least two outputs (25, 26) connected to said electronic program control unit (1) through said selector control means (13, 14) and adapted to be selectively activated in responss to the result of said comparison.

6. A control apparatus according to claim 5, wherein said selector control means comprises at least a first and a second logic AND gate (13, 14) having their respective first inputs (15, 16) connected to respective outputs (25, 26) of said digital comparator (12), and their respective second inputs (17, 18), connected to the output (19) of said flip-flop circuit (9), said first and second AND gates (13, 14) having their respective outputs (21, 22) connected to said electronic program control unit (1).

7. A control apparatus according to claim 6, wherein said digital counter (10), said clock signal generator (11), said digital comparator (12) and said logic AND gates (13, 14) may be incorporated in said electronic program control unit.

8. A control apparatus according to claim 5, wherein said digital counter (10), said clock signal generator (11), said digital comparator (12) and said logic AND gates (13, 14) may be incorporated in said electronic program control unit.

9. A control apparatus according to claim 4, wherein said digital counter (10), said clock signal generator (11), said digital comparator (12) and said logic AND gates (13, 14) may be incorporated in said electronic program control unit (1).

* * * * *

UNITED STATES PATENT AND TRADEMARK OFFICE

CERTIFICATE OF CORRECTION

PATENT NO. : 5,156,025

DATED : October 20, 1992

INVENTOR(S) : Giuseppe Frucco

It is certified that error appears in the above-identified patent and that said Letters Patent is hereby corrected as shown below:

Column 1, lines 59 - 60, delete "BRIEF DESCRIPTION OF THE PREFERRED EMBODIMENT" and insert --BRIEF DESCRIPTION OF THE DRAWINGS--.

Column 2, line 4, delete "drawing";

line 26, delete "elements" and insert --element's--; and line 56, delete "itself" and insert --. The digital counter is--.

Column 4, line 10, delete "being" and insert --is--: and line 49, delete "and".

Column 5, line 10, after "synthetic" insert --fabrics,--; and line 12, delete "1" and insert --"1"--.

UNITED STATES PATENT AND TRADEMARK OFFICE

CERTIFICATE OF CORRECTION

PATENT NO. : 5,156,025

DATED : October 20, 1992

INVENTOR(S) : Giuseppe Frucco

It is certified that error appears in the above-identified patent and that said Letters Patent is hereby corrected as shown below:

Column 6, Claim 5, line 52, delete "responss" and insert --response--.

Signed and Sealed this

Second Day of November, 1993

Bruce Lehman

*Attest:*

BRUCE LEHMAN

*Attesting Officer*

*Commissioner of Patents and Trademarks*